US012122568B2

(12) United States Patent
Wassum et al.

(10) Patent No.: US 12,122,568 B2
(45) Date of Patent: Oct. 22, 2024

(54) COMPOSITE PACK HAVING AN ELLIPTICAL LAMINATED HOLE, A CARDBOARD/PLASTIC COMPOSITE MATERIAL, A BLANK MADE FROM THIS, AND A POURING ELEMENT FOR USE WITH SUCH A COMPOSITE PACK

(71) Applicant: SIG Services AG, Neuhausen am Rheinfall (CH)

(72) Inventors: Markus Wassum, Buch (CH); Remo Zürcher, Winterthur (CH)

(73) Assignee: SIG Services AG, Neuhausen am Rheinfall (CH)

( * ) Notice: Subject to any disclaimer, the term of this patent is extended or adjusted under 35 U.S.C. 154(b) by 332 days.

(21) Appl. No.: 17/262,324

(22) PCT Filed: Jul. 16, 2019

(86) PCT No.: PCT/EP2019/069122
§ 371 (c)(1),
(2) Date: Jan. 22, 2021

(87) PCT Pub. No.: WO2020/020706
PCT Pub. Date: Jan. 30, 2020

(65) Prior Publication Data

US 2021/0331828 A1 Oct. 28, 2021

(30) Foreign Application Priority Data

Jul. 23, 2018 (DE) ..... 10 2018 117 707.0
Jul. 23, 2018 (EP) ..... 18020342

(51) Int. Cl.
*B65D 5/74* (2006.01)
*B65D 5/06* (2006.01)

(52) U.S. Cl.
CPC ..... *B65D 5/748* (2013.01); *B65D 5/064* (2013.01)

(58) Field of Classification Search
CPC ..... B65D 5/747; B65D 5/064; B64D 5/748
(Continued)

(56) References Cited

U.S. PATENT DOCUMENTS 3,982,427 A * 9/1976 Decker ..... G01N 3/36 73/815
4,801,007 A * 1/1989 Rule ..... A61J 11/0095 206/217

(Continued)

FOREIGN PATENT DOCUMENTS

CN 1290226 A 4/2001
CN 1476403 A 2/2004

(Continued)

*Primary Examiner* — Ernesto A Grano
*Assistant Examiner* — Symren K Sanghera
(74) *Attorney, Agent, or Firm* — The Webb Law Firm

(57) ABSTRACT

The invention illustrates and describes a composite pack, in particular a parallelepipedal cardboard/plastic composite pack for pourable products, having an elliptical laminated hole which is provided in the composite pack gable, with an elliptical main axis and an elliptical minor axis, and a pouring element, comprising a basic body, a cutting element movably guided in the basic body and having the shape of a hollow cylinder with a cylinder outer diameter and a resealable screw cap, wherein the screw cap serves for opening the composite pack for the first time by activation of the cutting element, which thus forms a pouring opening in the region of the laminated hole and wherein first guidance means configured on the cutting element interact with second guidance means configured on the basic body. In order to create the largest possible outflow diameter, while maintaining an already existing variant of a laminated hole, or in order to optimise the system of laminated hole and (Continued)

cutting element below its normal limits, it is provided that the cylinder external diameter is at least as big as the length of the elliptical minor axis. This leads to the side wall of the hollow cylinder-shaped cutting element extending the laminated hole at least in sections.

14 Claims, 7 Drawing Sheets

(58) Field of Classification Search
USPC ..... 222/81
See application file for complete search history.

(56) References Cited

U.S. PATENT DOCUMENTS

| | | | | |
|---|---|---|---|---|
| 5,960,992 | A * | 10/1999 | Bernstein | B67B 7/26 222/88 |
| 6,279,779 | B1 * | 8/2001 | Laciacera | B65D 5/748 222/541.2 |
| 6,554,181 | B1 | 4/2003 | Dammers et al. | |
| 7,051,896 | B2 | 5/2006 | Steadman | |
| 7,364,065 | B2 | 4/2008 | Willemsen | |
| 7,484,641 | B2 * | 2/2009 | Casale | B65D 5/748 222/83.5 |
| 7,959,032 | B2 | 6/2011 | Bolli | |
| 7,997,436 | B2 | 8/2011 | Bolli | |
| 8,714,380 | B2 * | 5/2014 | Casale | B65D 5/029 215/297 |
| 9,051,078 | B2 | 6/2015 | Martini et al. | |
| 9,511,559 | B2 | 12/2016 | Wolters et al. | |
| 10,081,462 | B2 | 9/2018 | Largacha et al. | |
| 2003/0215599 | A1 * | 11/2003 | Nishizawa | B29C 45/2606 425/406 |
| 2005/0120857 | A1 * | 6/2005 | Pfaff | B26D 7/2628 83/345 |
| 2006/0071000 | A1 * | 4/2006 | Weist | B65D 5/748 220/521 |
| 2007/0215620 | A1 | 9/2007 | Kasper | |
| 2008/0210707 | A1 * | 9/2008 | Kitai | B65D 75/5877 222/129 |
| 2009/0302037 | A1 | 12/2009 | Rigling | |
| 2012/0138634 | A1 * | 6/2012 | Benko | B65D 5/064 229/200 |
| 2015/0144630 | A1 | 5/2015 | Martin et al. | |
| 2019/0071224 | A1 * | 3/2019 | Berge | B65D 5/748 |
| 2019/0144158 | A1 * | 5/2019 | Hauser | B65D 51/226 222/81 |
| 2019/0193894 | A1 * | 6/2019 | Hauser | B65D 5/748 |
| 2019/0299576 | A1 * | 10/2019 | Alef | B32B 27/08 |

FOREIGN PATENT DOCUMENTS

| | | | |
|---|---|---|---|
| CN | 1496322 | A | 5/2004 |
| CN | 101107174 | A | 1/2008 |
| CN | 101316762 | A | 12/2008 |
| CN | 101316765 | A | 12/2008 |
| CN | 101346285 | A | 1/2009 |
| CN | 102673859 | A | 9/2012 |
| CN | 106414258 | A | 2/2017 |
| DE | 60209689 | T2 | 10/2006 |
| DE | 102006015525 | B3 | 8/2007 |
| DE | 102012012937 | B3 | 3/2013 |
| EA | 200702016 | A1 | 4/2009 |
| EP | 1088765 | A1 | 4/2001 |
| EP | 1931571 | B1 | 1/2010 |
| KR | 1020080114671 | A | 12/2008 |
| KR | 1020080114672 | A | 12/2008 |
| WO | 2011092002 | A1 | 8/2011 |

* cited by examiner

COMPOSITE PACK HAVING AN ELLIPTICAL LAMINATED HOLE, A CARDBOARD/PLASTIC COMPOSITE MATERIAL, A BLANK MADE FROM THIS, AND A POURING ELEMENT FOR USE WITH SUCH A COMPOSITE PACK

CROSS-REFERENCE TO RELATED APPLICATIONS

This application is the United States national phase of International Application No. PCT/EP2019/069122 filed Jul. 16, 2019, and claims priority to German Patent Application No. 10 2018 117 707.0 filed Jul. 23, 2018 and European Patent Application No. 18020342.4 filed Jul. 23, 2018, the disclosures of which are hereby incorporated by reference in their entirety.

BACKGROUND OF THE INVENTION

Field of the Invention

The invention relates to a composite pack, in particular a parallelepipedal cardboard/plastic composite pack for pourable products, having an elliptical laminated hole which is provided in the composite pack gable, with an elliptical main axis and an elliptical minor axis, and a pouring element, comprising a basic body, a cutting element movably guided in the basic body and having the shape of a hollow cylinder with a cylinder outer diameter and a resealable screw cap, wherein the screw cap serves for opening the composite pack for the first time by activation of the cutting element, which thus forms a pouring opening in the region of the laminated hole and wherein first guidance means configured on the cutting element interact with second guidance means configured on the basic body. The invention also relates to a cardboard/plastic composite material and a blank made from this, and a pouring element for use with such a composite pack.

Description of Related Art

Composite packs, comprising a cardboard/plastic composite material pack (hereinafter referred to as pack) and a pouring element, are known in practice in a large number of variations. The precise layer structure of the composite material may vary according to requirements but comprises at least one carrier layer made of cardboard and top layers in plastic. A barrier layer (such as aluminium, polyamide or ethylene-vinylalcohol-copolymer) may also be necessary in order to ensure an enhanced barrier effect for aseptic filling products against gases and in the case of aluminium against light also.

Such a pack is normally produced in one of two types of packaging machines. In the first alternative a continuous web of sterilised composite material is formed into a tube and sealed, after which it is filled with similarly sterilised filling product and then sealed and cut at uniform intervals transversally thereto. The resulting, "pillow packs" are then formed along the pre-folded edges into parallelepipedal packs. The sealed seam that results in the gable region during transversal sealing is normally referred to as a gable seam. The other variant uses blanks made of composite material, which are first formed into carton sleeves by sealing along the longitudinal seam and then formed on mandrels into semi-finished packs with an opening on one side, sterilised, filled and finally sealed and end-formed.

For ease of use during pouring and to allow resealing, pouring elements are also applied to the gable of the composite pack. The most commonly-used of these pouring elements come in three parts and comprise a basic body, adhering to the outer side of the composite material, a screw cap and a hollow cylinder-shaped cutting element, which opens the previously gas-tight pack for the first time and thus forms its pouring opening. These pouring elements are usually applied by separate machines, either with the help of hot melt adhesives or by welding of the basic body to the outer plastic coating.

Since the composite material, due to its stable layer structure, is extremely difficult to separate, the composite pack is normally suitably adapted. The pouring element with its cutting element could be designed to be sufficiently stable to easily cut through the entire composite material. But this can mostly be ruled out on cost grounds. It is therefore normal for the opening region to be prepared in such a way that a weakening arises there, which is mainly known in two different designs. Firstly, what are known as weakening lines are positioned in the outer layers of the composite materials, which are matched to the geometry and size of the cutting elements to be used and allow easier separation. Secondly, the weakened region can be designed as what is known as a "laminated hole". The first two options have the disadvantage that in each case open cardboard edges result, which during pouring come into direct contact with the filling product. This can lead to cardboard fibres in the product and to impairment of the taste thereof. Therefore, a laminated hole is normally the preferred solution.

A laminated hole, as described in EP 2 528 731 A1 by the applicant is formed during the composite material production. Here, a hole is stamped in the cardboard carrier layer, so that following coating with the plastic top layers a localised weakening in the composite material results. It therefore comprises all the normal layers of the composite without the stamped cardboard carrier layer: the top layers, a possible barrier layer and if necessary laminating layers and adhesive layers. For the purpose of this invention, the size of the laminated hole intended to be defined as that of the stamped hole in the cardboard carrier layer, and not the point at which the other layers meet.

In practice it has been found that this type of packaging weakening cannot be placed too close to the pack edges or the gable seam. In particular, the very high sheet speeds during lamination of the composite material lead to such restrictions. So, depending on the dimensions of the gable region of the pack, there is a certain size of the laminated hole, that cannot be exceeded. The restriction here is mostly the width of the pack gable, thus the distance between the gable seam and the pack edge parallel thereto. On the other hand, the later gable seam during the lamination process is in the direction of movement, which in turn is associated with increased tolerances of the hole in this longitudinal extension. However, since the width of the pack gable is transversal to the direction of movement, in the direction of movement, the hole—where it is not restricted by edges that are too close and where it has higher tolerances—has a longer design than transversally thereto. This results in a roughly elliptical hole shape with the elliptical main axis along the direction of movement and the elliptical minor axis transversally thereto. Such an elliptical hole shape can be designed as an elongated hole.

However, in other production systems, the later gable seam is transversal to the direction of movement, preventing the abovementioned design and resulting in a round hole shape with a radius that is just as restricted by the width of the gable as the minor axis of the ellipse in the first example.

EP 1 088 765 A1 describes a pouring element and an associated generic composite pack. The basic body, screw cap and cutting element together form a pouring element which during first operation separates the laminated hole in a large region and pushes the unpenetrated part of this to the side, to create a pouring opening. Here, the cutting element is guided in its movement by a thread on its outer side in the basic body and is actuated by the screw cap.

Basically, a larger cutting element is always desirable, since this allows a larger volume flow during pouring which, in turn, leads to greater speed and control, in particular avoidance of "gurgling". Obviously, though, there are a number of different products and applications. This means that a wide choice of different pouring elements in different sizes is available. The interface in the form of the laminated hole, which is invisible to the consumer, is only relevant to this choice to the extent that the cutting element can easily separate this while the basic body is always applied cleanly outside of this. A new design of the laminated hole always comes with investment costs in the form of new stamping tools and impression cylinders with adapted print images, as well as potentially high production costs of recalibrating the production processes.

On this basis, the object of the present invention is to redesign and develop the abovementioned composite pack already described in more detail in such a way that while retaining an already existing variant of a laminated hole the greatest possible outflow diameter can be created, or that the system of laminated hole and cutting element is optimised beyond its normal limits.

SUMMARY OF THE INVENTION

The object is achieved with a composite pack with the features of the invention in that the cylinder external diameter is at least as big as the length of the elliptical minor axis. This leads to the cutting line of the cutting element running along or even outside the edge of the laminated hole and therefore the laminated hole being extended with the side wall of the hollow cylinder-shaped cutting elements at least in sections. In this way, an optimally-sized outflow diameter is achieved relative to the laminated hole.

This object is also achieved by a cardboard/plastic composite material, a blank made of this and a pouring element which each constitute a part of such a composite pack.

A further teaching of the invention provides that the lengths of the elliptical main axis and of the elliptical minor axis correspond and the laminated hole thus has a circular design.

In further advantageous designs the cutting element for first-time opening of the composite pack is designed to be movable on a screw thread-shaped track or a track with different pitches. Thus, the cutting element can be guided as easily as possible on a thread or also in different variants on a plurality of successive sections. Here, individual sections can guide the cutting element purely axially downwards, purely horizontally, or with any pitches of their screw thread-shaped tracks.

A further development of the invention provides that the first guidance means is designed in a lower region facing the laminated hole with a smaller height than the remaining region. With the present invention in particular, very high forces act on the guidance means, when the cutting element penetrates the pack. In contrast to the known systems in which cutting only takes place in the region of the laminated hole, here the cutting element is always brought into contact with the cardboard carrier layer or even displaces this at least in a certain region. Thus, the further the cutting element has already penetrated the laminated hole, the smaller the remaining regions in which the first and second guidance means further interlock. Only the upper region of the cutting element and correspondingly the lower region of the basic body or its guidance means are in the end position. Therefore, in that upper region, the first guidance means should remain as sturdy as possible, while in the lower region as little friction as possible should be generated when penetrating through the laminated hole and thus along the cardboard carrier layer edge. The lower region of the first guidance means should therefore be designed with the lowest possible height.

According to a further teaching of the invention the lower region of the opened composite pack should be below the laminated hole and thus inside the composite pack. This describes the position of the cutting element in relation to the pack in its end position at the end of the composite pack opening process.

In a further expedient embodiment the first and second guidance means are designed as a combination of individual guide walls and/or individual cams. This allows optional combinations of sections, defining various pitches of the path of the cutting element. As soon as the cutting element is set in motion by the screw cap, the cams can be guided along the guide walls and thus steer the cutting element along the specified path. Various embodiments are conceivable here, such as, for example, guide walls on the cutting element and basic body or also cams on one of the two components combined with guide walls on the respective other.

In a further form of the invention, the first guidance means are configured as a first thread and the second guidance means as a second thread. This solution is above all applied if an individual helical movement is to be performed. A pair of threads also offers the advantage that the two interacting parts are in contact with each other over an extended range and thus offer enhanced resistance to the forces generated during the opening process.

Another teaching of the invention provides that the first thread has an interrupted configuration in the bottom region. Interruptions in the thread allow the resistances that arise during penetration through the laminated hole to be reduced. In particular also, on a multi-start thread these can be configured such that for a specific penetration depth in each case at least a part of each thread is interrupted. Interruptions at various heights in the respective threads can, by way of example, allow a reduction in the average external diameter in the lower region of the cutting element, without an associated excessive variance in this. This allows an easier and even penetration through the laminated hole.

According to a particular version, the heights of the thread sections in the lower region of the cutting element are configured to slope forwards in the direction of rotation. During the helical penetration the part of a respective thread section in the direction of rotation is the first part to come into contact with the surface of the pack. Therefore penetration is made easier if this part is sloped at the lowest possible angle, to allow a constant screwing-in of this thread section.

According to a further teaching of the invention, the second thread is designed as thread sections and/or cams. On the one hand the intention is, if possible, to save material in such consumable items and for this reason alone such a design of the second thread is suitable. On the other, when there is more than one thread, it is often necessary to interrupt the thread to allow the production tooling to be designed as simply and cost-effectively as possible. Finally, this can also be designed as described in EP 1 931 571 B1 by the applicant, to allow a simple and direct assembly of the various individual parts of the pouring element. This simplified assembly works in particular in conjunction with the interruptions in the first thread.

According to a further teaching of the invention, the pouring element and the laminated hole are arranged eccentrically, so that even if the cylindrical external diameter corresponds precisely to the length of the elliptical minor axis, when opening for the first time the cutting element lies at least partially outside the laminated hole. This eccentric arrangement often arises if the pouring elements are applied by a corresponding application device to the packs. Such devices always have a certain tolerance, which in many cases makes it impossible for the corresponding parts to fit together exactly. In the prior art this leads to the cutting path of the cutting element being somewhat closer to the edge of the laminated hole but not outside of this. So, from this aspect, the specific embodiment of the composite pack also allows application devices with high tolerances and thus also associated high speeds.

In a further form of the invention, the cutting element is made from impact-modified polystyrene. Unlike the polypropylene and polyethylene normally used for cutting elements, an impact-modified polystyrene ensures a more stable component.

BRIEF DESCRIPTION OF THE DRAWINGS

The invention is described below using a drawing showing just one preferred exemplary embodiment. The drawing shows as follows.

DESCRIPTION OF THE INVENTION

Figure 1A:
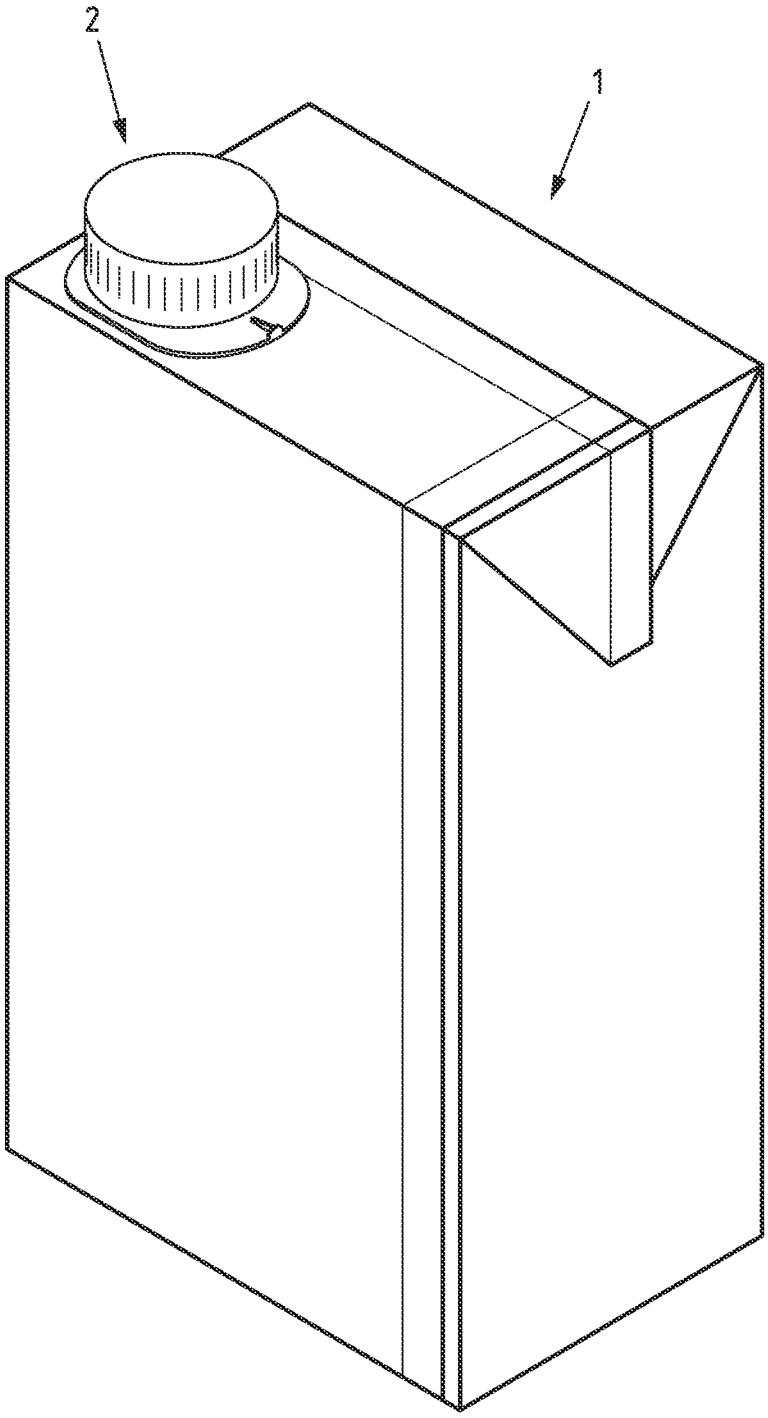
FIGS. 1A and 1B a perspective view of a composite pack according to the invention with and without pouring element applied.
Figure 1B:
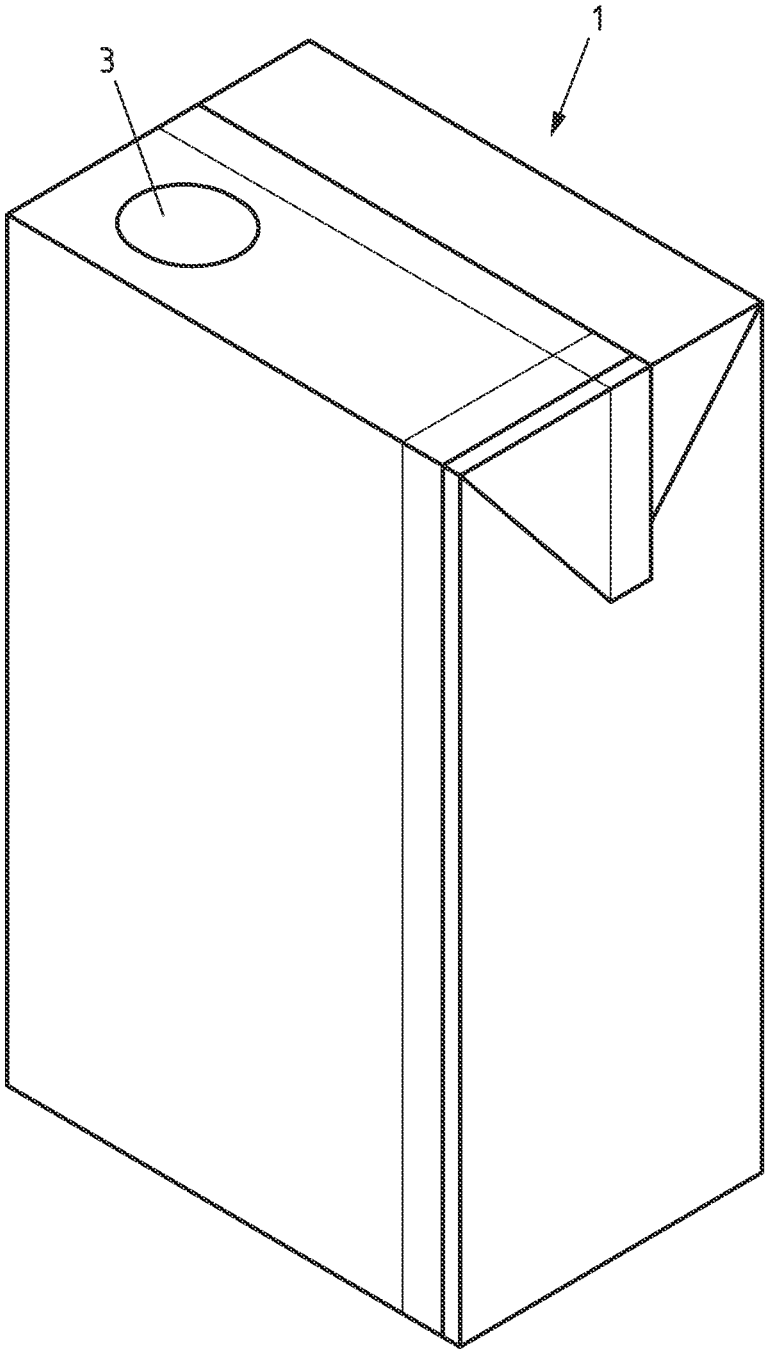

FIG. 1A shows a composite pack 1, as previously known for a long time in itself in the form of a parallelepipedal cardboard/plastic composite pack for pourable products. A pouring element 2 is shown arranged in the region of a subsequent opening, which opens the composite pack 1 when operated for the first time. FIG. 1B also shows a laminated hole 3, allowing simplified opening of the composite pack 1.

Figure 2A:
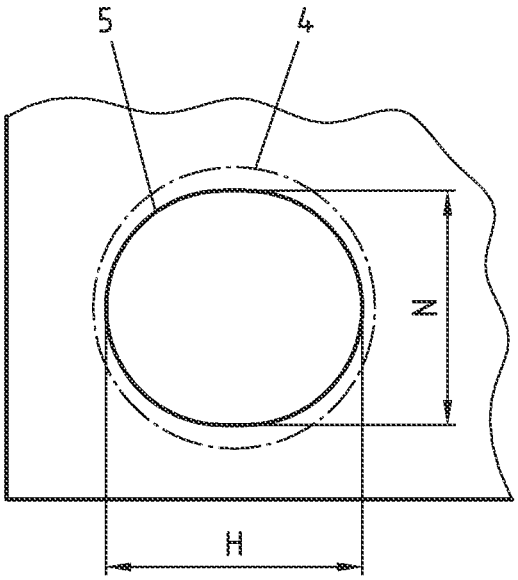
FIGS. 2A to 2E a top view of the laminated hole of a composite pack according to FIG. 1B with the cutting line plotted, in various designs.
Figure 2B:
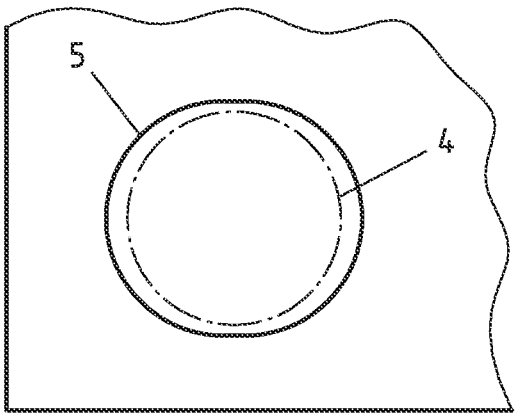
Figure 2C:
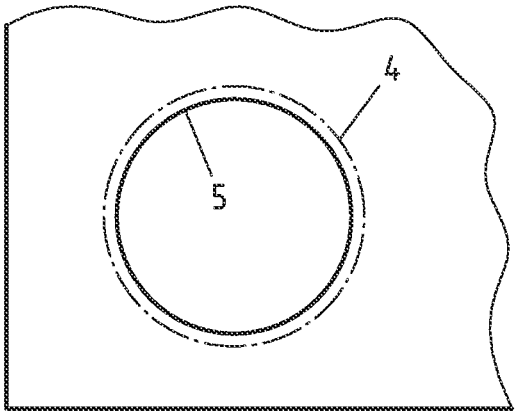
Figure 2D:
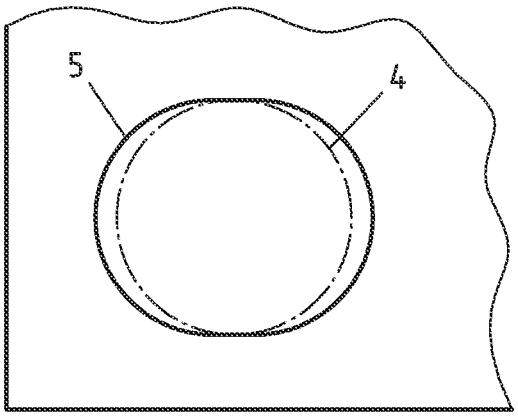
Figure 2E:
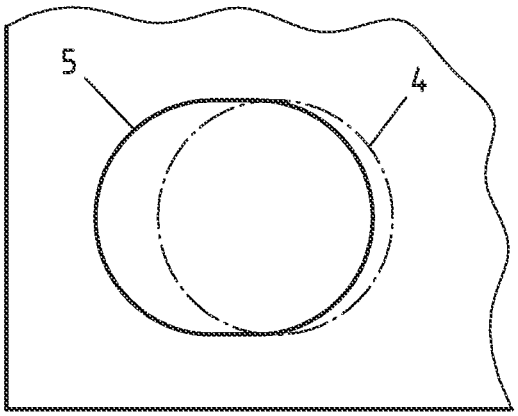

The enlargement of the opening region in FIG. 2A clearly shows where the cutting line 4 of a cutting means is in relation to the edge 5 of the laminated hole 3. A design according to the invention with an elliptical laminated hole 3 with elliptical main axis H and elliptical minor axis N is shown here together with the cutting line 4, corresponding to the cylinder external diameter D. Thus, the edge region of the laminated hole 3 is expanded during the opening process. FIG. 2B shows an opening region, as known from the prior art. FIG. 2C illustrates a further variant according to the invention, wherein here the laminated hole 3 has a circular design. FIG. 2D shows a design according to the invention in which the cutting line 4 comes to rest precisely on the edge 5. Finally, FIG. 2E is the same variant again as shown in FIG. 2D, but with an eccentrically applied pouring element 2. Here, the laminated hole 3 is expanded more on one side during the opening process.

Figure 3:
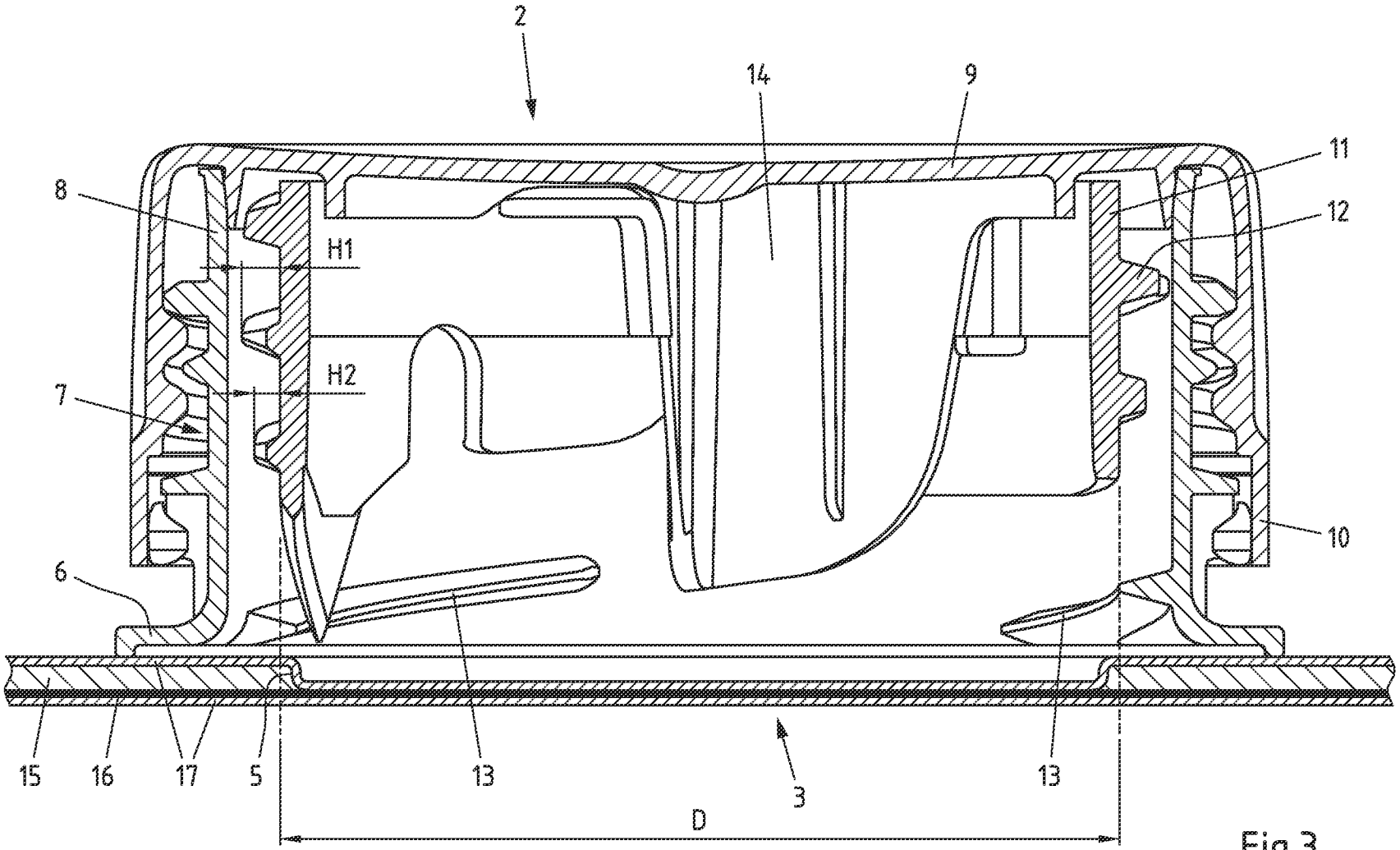
FIG. 3 a vertical view of a pouring element from FIG. 1A applied according to the invention.

FIG. 3 firstly shows a vertical section of the opening region of a composite pack 1. Here, the pouring element 2 is applied with a flange 6 of its basic body 7 around the laminated hole 3. Apart from the flange 6, the basic body 7 also has a tube 8. A screw cap 9, serving for opening for the first time and subsequent resealing of the composite pack 1, is also provided with an anti-tamper ring 10, which during operation for the first time of the screw cap 9 breaks away from this and remains in the lower region of the basic body 7. The cutting element 11 is connected via its first guidance means 12 with the second guidance means 13 of the basic body and guided therein, wherein in the exemplary embodiment shown, and in this connection preferred, this is designed as a pair of threads with interruptions. When guided in its movement path, the cutting element 11 is driven by a drive element 14 of the screw cap 9 during opening for the first time and moved helically down. During this movement, the composite pack 1 is separated in the region of the laminated hole 3 and the edge region extended. The sectional view also clearly shows the lower height H2 of the first thread in the lower region of the cutting element 11, and also the normal height H1 in the remaining region.

The cardboard/plastic composite material comprises a cardboard carrier layer 15, an aluminium layer 16 and internal and external top layers 17. Particularly easily identifiable is also the stamped edge 5 of the cardboard carrier layer 15, defining the outer border of the laminated hole 3. So, similarly visible is the overlapping of the cutting element 11 with this region.

Figure 4:
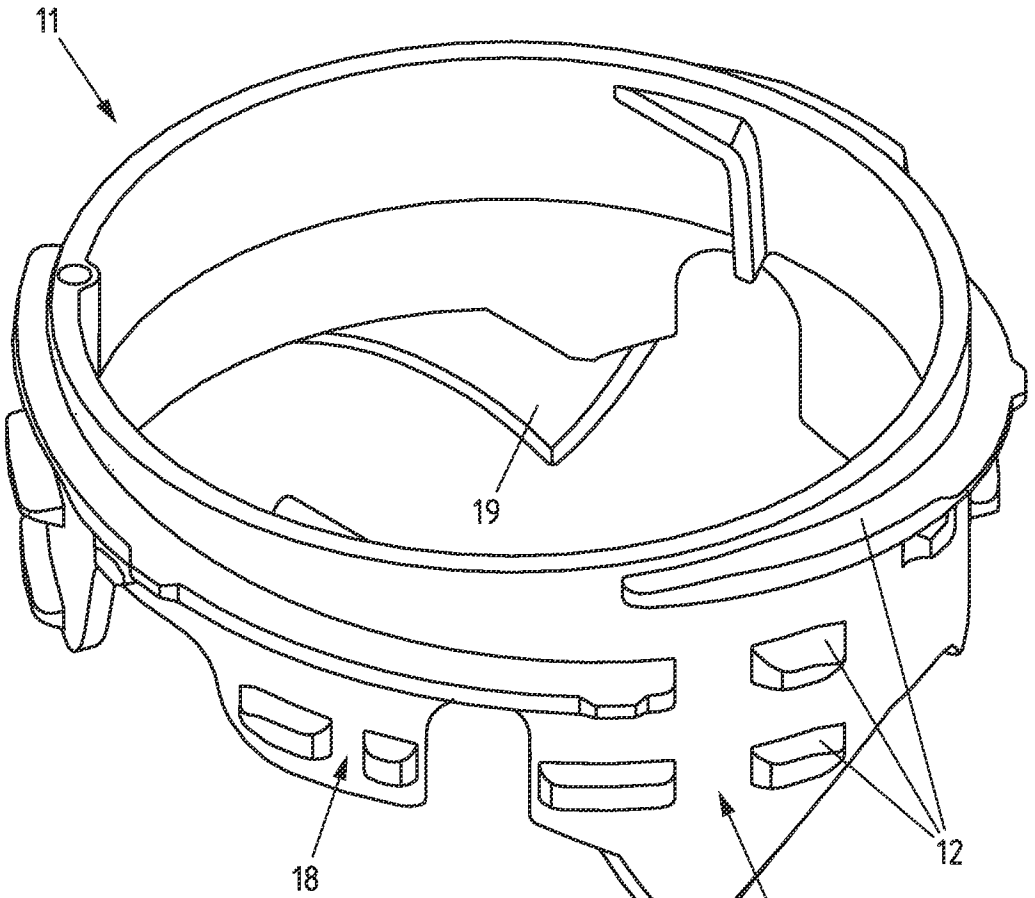
FIG. 4 a perspective view of a cutting element according to the invention of a pouring element.

In FIG. 4, the cutting element 11 is shown in detail. Here in particular, the first guidance means 12 are visible, in the form of external threads with interruptions 18. These interruptions 18 in the thread allow simplified assembly of the three-part pouring elements and also certain savings on materials. Furthermore, as can be seen more clearly in FIG. 3A, the thread is also configured in the lower region with a smaller height which, together with the interruptions 18, makes penetration into the composite material easier. In the preferred exemplary embodiment, the cutting element 11 also has two approximately opposing cutting teeth 19, for perforating and separating the composite material.

Figure 5:
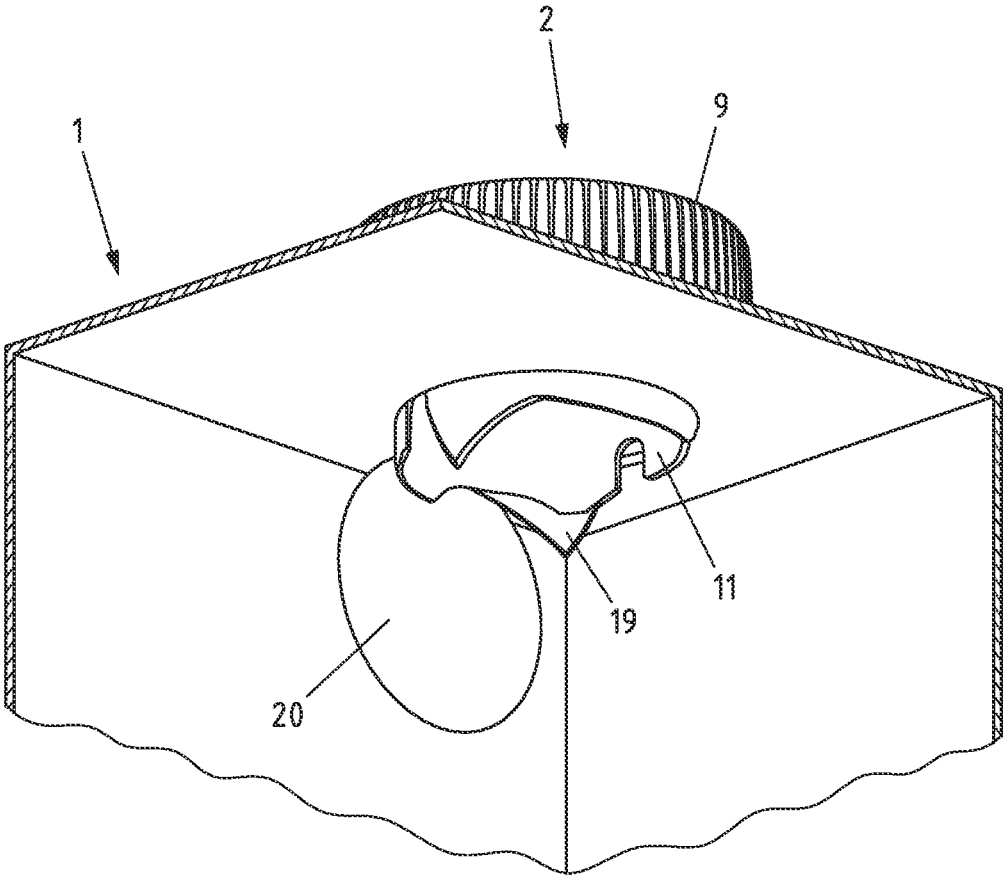
FIG. 5 a composite pack according to the invention with applied pouring element after opening for the first time and resealing, shown in sliced, perspective view.

In the section view of FIG. 5, the opened composite pack is shown from the inside, wherein above all a tab 20 is apparent. This results because during the separation process the laminated hole 3 loses its tension before the cutting element 11 can cut a complete circle. The tab 20, corresponding approximately to the separated laminated hole 3, held on by just one individual segment, is pushed to the side by the further movement of the cutting element 11 and thus exposes the pouring opening. This segment is sufficient to maintain the tab 20 in its "flipped open" state when the composite pack 1 is open, to reliably avoid an unintentional tearing-off of the tab 20. Since the cutting element 11 fills the complete laminated hole 3, unlike normal designs, no remaining edge region of the laminated hole 3 around the cutting element 11 is visible.

The invention claimed is:

1. A cardboard/plastic composite pack having an elliptical laminated hole which is provided in a composite pack gable, with an elliptical main axis and an elliptical minor axis and a pouring element, comprising a basic body, a cutting element movably guided in the basic body and having the shape of a hollow cylinder with a cylinder external diameter and a resealable screw cap, the cutting element separates the laminated hole and a portion of the composite pack, wherein the screw cap serves for opening the composite pack for the first time by activation of the cutting element, which thus forms a pouring opening in the region of the laminated hole and wherein first guidance means configured on the cutting element interact with second guidance means configured on the basic body, wherein the cylinder external diameter is bigger than the length of the elliptical minor axis; and wherein the first guidance means are configured as a first thread and the second guidance means as a second thread and the first thread has an interrupted configuration in a bottom region of the first thread.

2. The composite pack according to claim 1, wherein lengths of the elliptical main axis and of the elliptical minor axis correspond and the laminated hole thus has a circular design.

3. The composite pack according to claim 1, wherein the cutting element for first-time opening of the composite pack is designed to be movable on a screw thread-shaped track.

4. The composite pack according to claim 1, wherein the cutting element for first-time opening of the composite pack is designed to be movable on a track with different pitches.

5. The composite pack according to claim 1, wherein the first guidance means is configured in a lower region of the cutting element, the lower region facing the laminated hole with a smaller height than a remaining region.

6. The composite pack according to claim 5, wherein in the state of an opened composite pack, the lower region of the cutting element is below the laminated hole and inside the composite pack.

7. The composite pack according to claim 1, wherein the first and second guidance means are designed as a combination of individual guide walls and/or individual cams.

8. The composite pack according to claim 1, wherein the heights of thread sections in the lower region of the cutting element are configured to slope at the front in an opening direction of rotation, wherein the threaded sections are in the interrupted configuration of the first thread.

9. The composite pack according to claim 1, wherein the second thread is designed as thread sections and/or cams.

10. The composite pack according to claim 1, wherein the pouring element and the laminated hole are arranged eccentrically, so that even if the cylindrical external diameter corresponds precisely to the length of the elliptical minor axis, when opening for the first time the cutting element lies at least partially outside the laminated hole.

11. The composite pack according to claim 1, wherein the cutting element is made from impact-modified polystyrene.

12. A cardboard/plastic composite material having at least one cardboard carrier layer and at least one plastic material top layer, with incorporated creases for forming pack edges, for the production of cardboard/plastic composite packs as part of composite packs according to claim 1.

13. A blank made from cardboard/plastic composite material with creases incorporated in the material for forming pack edges, wherein the blank is configured with a size of a composite pack, for the production of a cardboard/plastic composite pack as part of a composite pack according to claim 1.

14. A pouring element with a basic body, a cutting element movably guided therein and a screw cap, for use as part of a composite pack according to claim 1.

* * * * *